US005493990A

United States Patent [19]

Dyer

[11] Patent Number: 5,493,990

[45] Date of Patent: Feb. 27, 1996

[54] HYDROFOIL WITH TROLLING PLATE

[76] Inventor: William B. Dyer, 3358 Taylor Rd., Central Point, Oreg. 97502

[21] Appl. No.: 436,745

[22] Filed: May 8, 1995

[51] Int. Cl.[6] ..... B63H 25/44

[52] U.S. Cl. ..... 114/145 A; 114/282

[58] Field of Search ..... 114/145 A, 274, 114/280, 282, 145 R; 440/51, 66, 900

[56] References Cited

U.S. PATENT DOCUMENTS

| | | | |
|---|---|---|---|
| 2,050,336 | 8/1936 | Karasinski | 115/17 |
| 2,256,898 | 9/1941 | Ehmke | 115/0.5 |
| 2,654,336 | 10/1953 | Katzung et al. | 115/0.5 |
| 2,719,503 | 10/1955 | Smith | 115/18 |
| 2,787,974 | 4/1957 | Johnson | 114/145 A |
| 3,209,716 | 10/1965 | Hartley | 114/145 |
| 3,965,838 | 6/1976 | Uht | 114/145 A |
| 4,048,940 | 9/1977 | Smith | 114/145 |
| 4,549,498 | 10/1985 | Meyer et al. | 114/145 A |
| 5,005,507 | 4/1991 | Dyer | 114/280 |
| 5,127,353 | 7/1992 | Wieser | 114/145 A |

*Primary Examiner*—Edwin L. Swinehart
*Attorney, Agent, or Firm*—James D. Givnan, Jr.

[57] ABSTRACT

A hydrofoil for attachment to an outdrive or outboard motor supports a trolling plate projecting rearwardly from the hydrofoil when in a raised position. The trolling plate includes a pair of arms having a lockable member therebetween slidably engageable with a latch pivotally mounted on the hydrofoil. Downward trolling plate deployment may occur upon elevation of the latch by an operator control which permits the lockable member to travel lengthwise of an elongate opening in the latch and into one of multiple catches in communication with the elongate opening. A first pair of torsion springs urge the trolling plate to a deployed position. A second set of torsion springs urge the latch toward a position securing the lockable member against movement. Multiple trolling plate positions allow maneuvering of a boat with a deployed trolling plate.

5 Claims, 2 Drawing Sheets

HYDROFOIL WITH TROLLING PLATE

BACKGROUND OF THE INVENTION

The present invention concerns generally trolling plates used to reduce boat propeller efficiency and hence boat speed to one suitable for trolling.

By way of background, the concept of positioning a baffle or plate structure rearward of a boat propeller for the above noted purpose is well known. To permit increased boat speeds such plates were swingably mounted on a support bracket in place on the lower housing of an outdrive or of an outboard motor with the plate being displaceable out of the propeller wash either manually or by a control from the boat operator's station.

Known trolling plates utilize various lock mechanisms which are subjected, in some instances, to substantial forces as for example when a trolling plate is left inadvertently in the down position when a boat motor is throttled up. Frequently the mechanical failure of a trolling plate renders it unuseable until repaired resulting in lost fishing time and expense to the boat owner.

Another drawback to known trolling plates is the loss of maneuverability. Blocking of a water flow to a propeller rotating in a reverse direction prevents rearward movement of a boat as well as rearward directional changes of the boat.

Prior art pertaining to trolling plates includes U.S. Pat. Nos. 2,719,503; 2,654,336; 1,576,237; 2,256,898; 2,050,336; 3,209,716; 3,965,838 and 4,048,940 to mention a few.

U.S. Pat. No. 5,005,507 issued to the present inventor discloses the novel combination of a hydrofoil and trolling plate unit for attachment to the cavitation plate of an outdrive or lower housing of an outboard motor. U.S. Pat. No. 4,487,152 discloses a hydrofoil in place on a cavitation plate. U.S. Pat. No. 5,127,353 shows a trolling plate on a hydrofoil with the plate locked in a vertical or horizontal position by a pin. A modified form of lock utilizes a bar engageable with slots in the trolling plate.

SUMMARY OF THE PRESENT INVENTION

The present invention is directed toward the provision of a trolling plate with a latch that cooperates with a lockable member on the plate to retain the plate in a desired operable position while providing a breakaway feature preventing structural damage to the plate or boat components.

A trolling plate carries a lockable member offset from the rotational axis of the plate. Said lockable member, during plate positioning, moves within a slot of a pivoted latch, at its forwardmost position in the slot, provides a mechanical lock holding the trolling plate up and locked in a non-operating position. Trolling plate movement toward a deployed position is by operator remote actuation of the pivoted latch. Once unlocked, spring components rotate the trolling plate downwardly to the position desired. The latch slot is preferably configured to retain the plate either fully or partially deployed with the latter permitting backing up of a boat and directional thrust from a propeller while doing same. The latch is spring biased to ensure latch-lockable member engagement for plate retention. Additional biasing elements act on the trolling plate to urge same toward deployed positions. Configuration of the latch slot permits plate retraction in response to increased propeller backwash.

Important objectives include the provision of a trolling plate which swings about a first horizontal axis and carries a lockable member offset from said axis and travels in a latch defined slot. Said lockable member has a forward position, locking the plate in a raised retracted position, and a deployed position or positions whereat the latch automatically engages the lockable member; the provision of a trolling plate which includes a breakaway feature allowing release of a spring biased latch and trolling plate retraction in the event of increased propeller backwash by a change in the throttle position of the boat motor; the provision of a locking mechanism for a trolling plate wherein the plate is held in a retracted, inoperable position by a lockable member, carried by plate mounted arms when located proximate an upright plane containing the pivotal axis of a latch engageable with said member.

DETAILED DESCRIPTION OF THE PREFERRED EMBODIMENTS

Figure 1A:
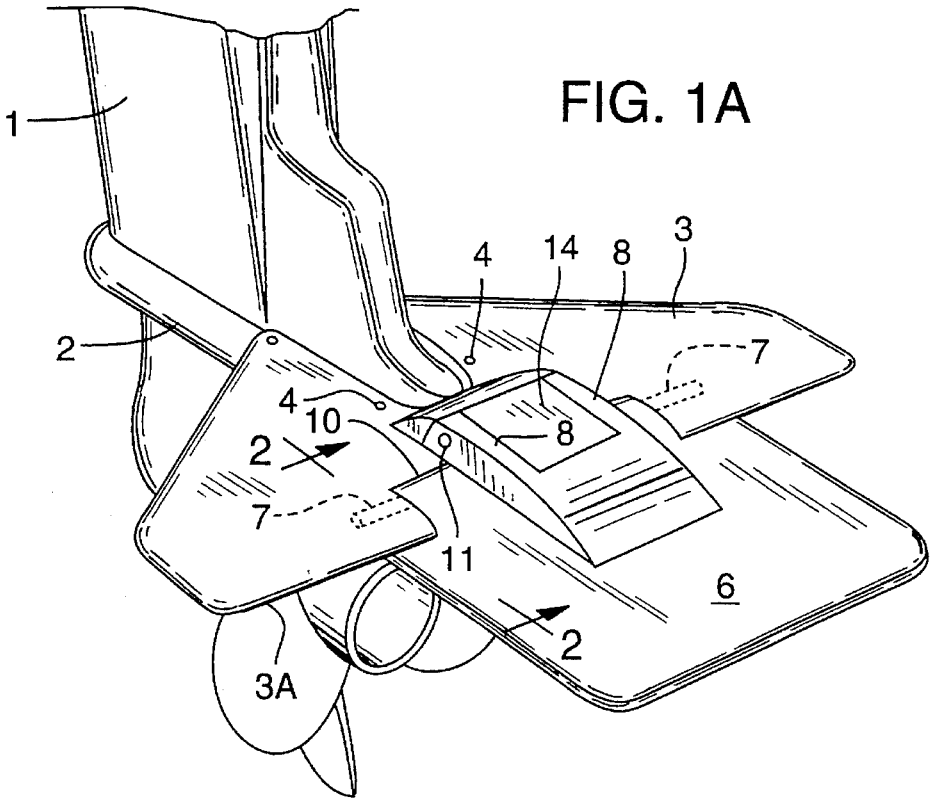
FIGS. 1A and 1B are perspective views of the lower housing of an outdrive or outboard motor with the present invention thereon shown retracted and deployed respectively.

With continuing attention to the drawings, the reference numeral 1 indicates the lower housing of a propulsion unit of a boat having a cavitation plate 2.

A base of the present invention is preferably in the shape of a hydrofoil 3 shown with fasteners 4 securing same in place on plate 2. While shown as a hydrofoil, the base may take other forms. A hydrofoil is preferred for the reason of imparting lift to the boat transom at speeds above those at which a trolling plate would be deployed.

A trolling plate at 6 is swingably mounted on a pivot shaft 7 carried adjacent the trailing edge 3A of base 3. In place on plate 6 are a pair of arms 8 which project forwardly, as viewed in FIG. 1, from the upper or forwardmost edge 10 of plate 6. A locking pin 11, termed hereinafter a lockable member, extends intermediate the forward ends of spaced apart arms 8 and is accordingly adapted for upward arcuate travel about shaft 7 to the position shown in FIG. 2 during trolling plate deployment. Torsion springs at 13 in FIG. 2 are carried by mandrels as at 12 formed on base 3 to bias plate 6 downward.

Figure 1B:
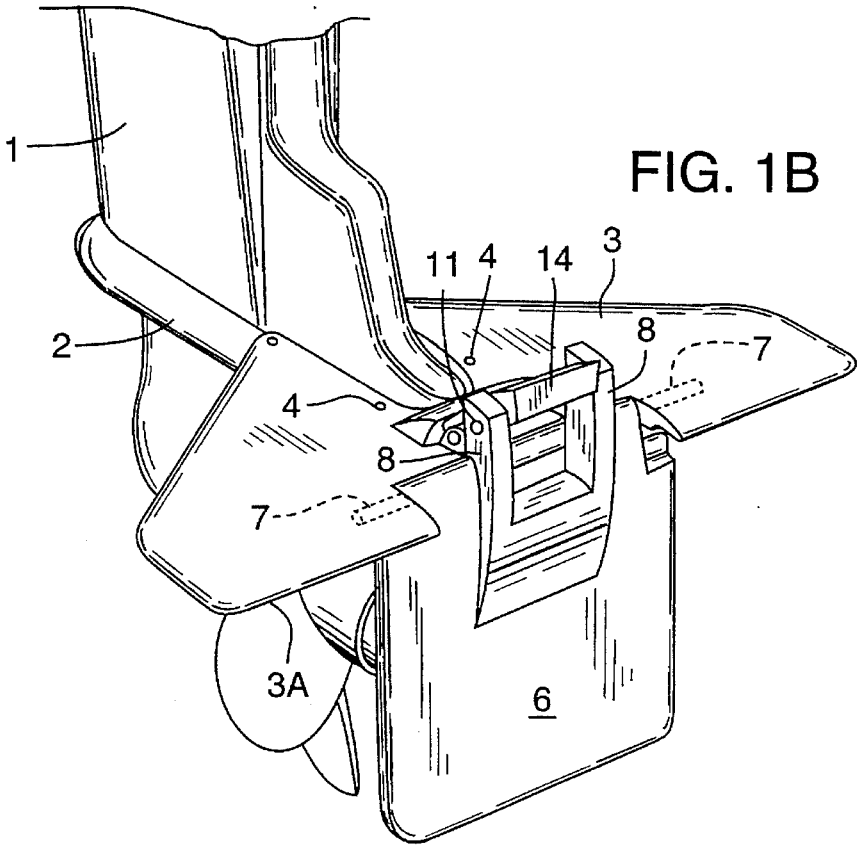
Figure 2:
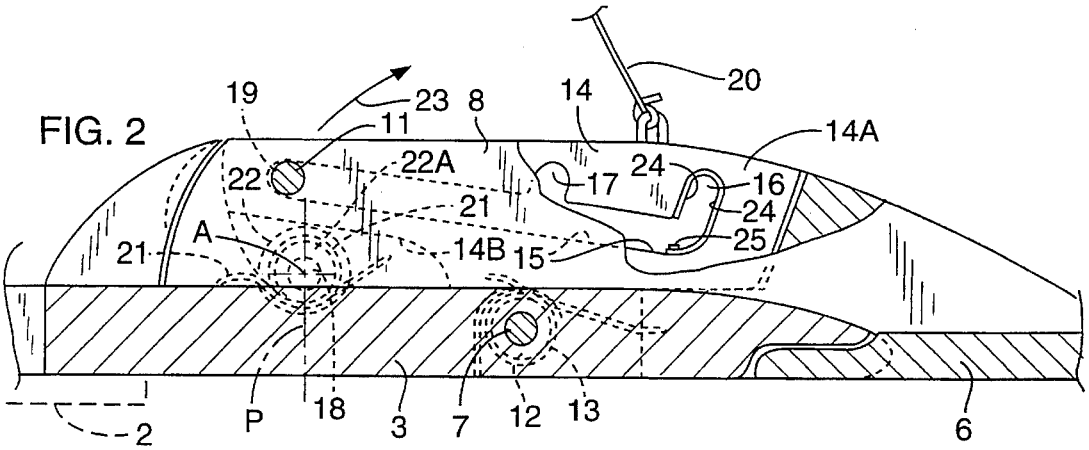
FIG. 2 is a vertical sectional view taken along line 2—2 of FIG. 1A.

A latch 14 is of elongate shape and serves to confine lockable member 11 against upward arcuate movement when the trolling plate is retracted to the inactive raised position of FIG. 1A. Latch 14, as viewed in FIG. 2, defines an elongate rearwardly and somewhat downwardly inclined slot 15 including catches at 16 and 17. Slot 15 terminates forwardly at 19 past a vertical plane P containing the major axis A of a latch pivot shaft 18. Accordingly, the trolling plate 6 as biased by torsion spring 13 tends to bias arm carried lockable member 11 upwardly about shaft in an arcuate manner. However, latch 14 is immobile against such forces by reason of lockable member 11 being proximate plane P, and preferably located past plane P, resulting in that portion of the latch, rearward of plane P, being confined downwardly to the locked position of FIG. 2. Latch 14 is, in effect, biased upwardly at its forward end by lockable member 11 resulting in the remaining rearward portion 14A of the latch, to the right of plane P, being urged downwardly to a locked position of FIG. 2.

Unlatching or raising the latch 14 is achieved by a remotely actuated control 20 lifting the right hand end of the latch whereupon pin 11 may move along an upward arcuate path at 23. Latch movement is in a counterclockwise direction about pivot shaft 18 against the action of a set of torsion springs one of which is shown at 21 with each in place on a mandrel 22A formed on an ear as at 22 on base 3. Springs 21 maintain either catch 16 or 17 in downward biased engagement with lockable member 11 with the intermediate catch 17 holding the trolling plate in the inclined broken line position of FIG. 3 and catch 17 holding the trolling plate in an upright position.

Figure 3:
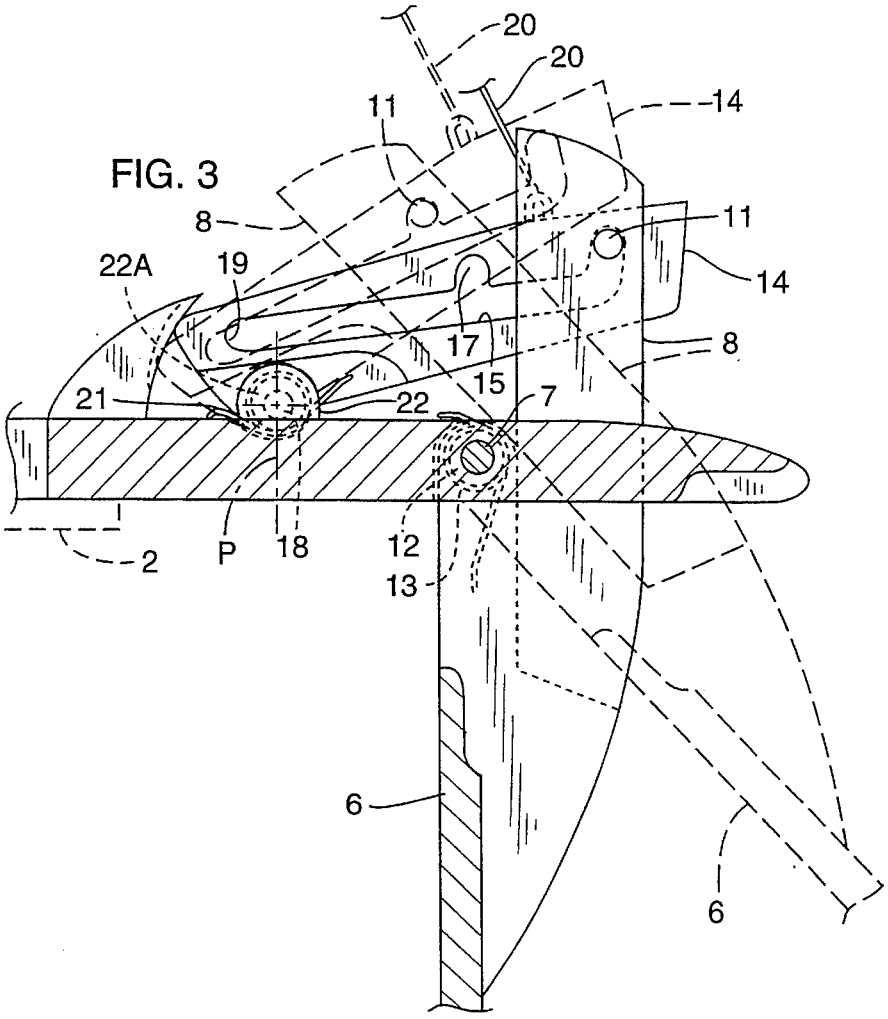
FIG. 3 is a view similar to FIG. 2 but with the trolling plate operatively disposed with an alternative plate position shown in broken lines.

In use, control 20 when actuated, lifts the trailing or rearward portion 14A of latch 14 whereupon lockable member 11 may move upwardly along arcuate path 23 in response to trolling plate springs 13. Such movement continues until lockable member 11 seats within intermediate catch 17 to position trolling plate 6 in the broken line, inclined position of FIG. 3. Such a position permits maneuvering of the boat since water flow is not blocked to or from the propulsion member such as the propeller shown in FIG. 1. In certain instances such an inclined position of the trolling plate may be adequate to diminish propeller backwash to provide a reduced speed trolling. If necessary, plate travel to the upright or solid line position of FIG. 3 is achieved by additional momentary actuation of control 20 to lift the latch free of lockable member 11, whereupon the spring biased trolling plate shifts lockable member 11 to seat in catch 16. At the termination of a trolling operation, control 20 is again tensioned to lift latch 14 resulting in lockable member 11 being free to follow a forwardly and downwardly arcuate path in response to increased propeller backwash acting on the trolling plate. Such backwash is adequate to overcome the action of trolling plate springs 13. Upon lockable member 11 coming to rest proximate vertical plane P, the plate springs 13 will impart an upward force on the lockable member 11 to lock latch 14 and particularly its rearward portion 14A retaining same in the down and locked position of FIG. 2.

To assure satisfactory release of lockable member 11 from rearward catch 16, a stainless steel insert 24 provides a reduced friction surface along the forward wall of the catch opening 16 to permit automatic upward movement of the latch 14 in the event a heavy backwash force is applied to a downwardly deployed trolling plate such as by a sudden increase in engine speed. Insert 24 extends the width of catch 16 and is of a flexible nature to permit seating of the insert within the catch opening with the insert being bifurcated to receive a projection 25 for insert retention.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. In combination, a base for attachment to the lower housing of an outdrive or outboard motor, a trolling plate and spring means biasing said plate downward to a deployed position, first pivot means coupling said trolling plate to said base, said trolling plate having a lockable member movable in an upward arcuate path during trolling plate movement toward a deployed position, a spring biased latch having an elongate opening therein in communication with a catch and biased to a position locking said lockable member, second pivot means coupling said latch to said base and lying in a vertical plane, said elongate opening in the latch terminating at a first end proximate said vertical plane and at a second end remote from said second pivot means, said lockable member carried by said trolling plate confined by said latch when in said first end of the elongate opening and proximate said vertical plane, and control means coupled to said latch member to elevate same about said second pivot means to release the locking member permitting upward arcuate travel of the locking member during trolling plate deployment.

2. In combination, a base for attachment to a propulsion component of a boat, a trolling plate including a lockable member for travel in an arcuate path, first pivot means coupling said trolling plate to said base for trolling plate movement about an axis, spring means biasing said trolling plate in a downward deployed direction and said lockable member in an upward direction, elongate latch means having an elongate opening along which said lockable member may travel, a catch in communication with said elongate opening and in which said lockable member may be received to lock said trolling plate in place about said first pivot means, second pivot means located in a vertical plane and coupling one end of said elongate latch means to said base for travel of the latch means about a horizontal axis, said elongate opening of the latch means terminating at one end proximate said vertical plane to permit locking in place said lockable member, and control means coupled to said elongate latch means and operable by the boat operator to elevate same to release the lockable member for spring biased deployment.

3. In combination, a hydrofoil for attachment to a boat propulsion unit, a trolling plate including a lockable member, first pivot means hingedly coupling said trolling plate to said hydrofoil, said lockable member swingable about said first pivot means, a latch having an elongate slot with a catch for the reception of said lockable member, second pivot means coupling said latch to said hydrofoil, control means coupled to said latch and operable by a boat operator to position said latch to release the lockable member for travel along said elongate slot toward said catch coincident with deployment of the trolling plate.

4. The combination claimed in claim 3 wherein said slot is in communication with multiple catches at intervals along said slot, and means biasing said latch toward engagement with said lockable member to engage one of said catches with said member to retain the trolling plate in selected deployed position.

5. The combination claimed in claim 4 additionally including spring means biasing said trolling plate toward a deployed position.

* * * * *